US005094465A

United States Patent [19]

Dawson

[11] Patent Number: 5,094,465

[45] Date of Patent: Mar. 10, 1992

[54] SHAPE RECOGNITION GAME

[76] Inventor: Dan Dawson, Box 3267, Valdez, Ak. 99686

[21] Appl. No.: 574,902

[22] Filed: Aug. 30, 1990

[51] Int. Cl.[5] ..... A63F 1/00

[52] U.S. Cl. ..... 273/429; 273/273; 273/292

[58] Field of Search ..... 273/273, 292, 272, 298, 273/299, 300, 301, 302, 308, 459, 429; 434/81, 85, 91, 92, 157, 176, 348, 403

[56] References Cited

U.S. PATENT DOCUMENTS

| | | | |
|---|---|---|---|
| 2,072,799 | 3/1937 | Creswell | 273/308 |
| 2,214,952 | 9/1940 | Carothers | 273/308 |
| 2,222,245 | 11/1940 | Steen | 434/348 |
| 2,319,162 | 5/1943 | Short | 434/92 |
| 2,324,691 | 7/1943 | Gardner | 273/359 |
| 2,840,926 | 7/1958 | Campbell | 434/157 X |
| 4,227,697 | 10/1980 | Castanis | 273/272 |
| 4,294,451 | 10/1981 | Wollner | 273/308 |
| 4,315,628 | 2/1982 | Balash | 273/308 X |
| 4,369,976 | 1/1983 | Chunn | 273/308 X |

*Primary Examiner*—William H. Grieb
*Attorney, Agent, or Firm*—Leon Gilden

[57] ABSTRACT

A game apparatus wherein a plural series of cards provides excessively greater clues relative to a particular configuration. Points are awarded based upon solving a random shape by the clues at a greater rate than upon earlier solving of the clues. The apparatus includes a game board for positioning the cards in relationship to the clue cards utilized, a clue card holder, and a viewing rack positioning the clue cards of each series with sequentially positioned doors for revealing sequentially the series of clue cards. An alternative third compartment of the viewing rack is provided wherein the final clue card of a series of clue cards is positioned and opaque slots are selectively removed to reveal various portions of the clue card to provide an individual an alternative manner of guessing a predetermined shape with a greater point total awarded with a lesser number of clues revealed of the final clue card of the series.

4 Claims, 3 Drawing Sheets

32a
30
32
33a
33
34a
34
35a
35
36a
36
37a
37
12c
29
28
27
38
38a
39
39a
40
40a
41
41a
42
42a
43
43a
31

SHAPE RECOGNITION GAME

BACKGROUND OF THE INVENTION

1. Field of the Invention

The field of invention relates to game apparatus, and more particularly pertains to a new and improved shape recognition game wherein the same directs individuals to solve shapes and awards points based upon clues given in solving the shape.

2. Description of the Prior Art

Game structure of various types have been utilized in the prior art to associate game cards and objects relative to the game cards. An example may be found in U.S. Pat. No. 4,315,628 to Balash, et al. wherein game cards are provided requiring physical participation of players, wherein a game card drawn directs a player to contact that portion of the human anatomy of an opposing player causing the player to assume various physical positions relative causing players to assume various physical positions building the various body parts thereof.

U.S. Pat. No. 2,214,952 to Carothers sets forth a game structure directing a series of cards in association with various food components.

U.S. Pat. No. 4,369,976 to Chunn sets forth of a card game with trump suits and trump words and various pictorial associations of animal and insect categories.

U.S. Pat. No. 2,072,799 to Creswell sets forth a plural group of animal cards, wherein the animal cards of each group bears a representation of a respective game animal depicting various bag limits and scoring values of the cards.

U.S. Pat. No. 4,294,451 to Wollner sets forth a card game wherein the cards are divided into a plurality of groups, with the groups divided by various objects pictorially represented on the cards.

As such, it may be appreciated that there continues to be a need for a new and improved shape recognition game wherein the same addresses both the problems of ease of use and effectiveness in construction in providing enjoyment and amusement in the play of the game organization and in this respect, the present invention substantially fulfills this need.

SUMMARY OF THE INVENTION

In view of the foregoing disadvantages inherent in the known types of game apparatus now present in the prior art, the present invention provides a shape recognition game wherein the same provides sequentially provided clues of sequentially provided cards to effect recognition of an object described by each series of cards. As such, the general purpose of the present invention, which will be described subsequently in greater detail, is to provide a new and improved shape recognition game which has all the advantages of the prior art game apparatus and none of the disadvantages.

The attain this, the present invention provides a game apparatus wherein a series of cards provides excessively greater clues relative to a particular configuration. Points are awarded based upon solving a random shape by the clues at a greater rate than upon earlier solving of the clues. The apparatus includes a game board for positioning the cards in relationship to the clue cards utilized, a clue card holder, and a viewing rack positioning the clue cards of each series with sequentially positioned doors for revealing sequentially the series of clue cards. An alternative third compartment of the viewing rack is provided wherein the final clue card of a series of clue cards is positioned and opaque slots are selectively removed to reveal various portions of the clue card to provide an individual an alternative manner of guessing a predetermined shape with a greater point total awarded with a lesser number of clues revealed of the final clue card of the series.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shape recognition game which has all the advantages of the prior art game apparatus and none of the disadvantages.

It is another object of the present invention to provide a new and improved shape recognition game which may be easily and efficiently manufactured and marketed.

It is a further object of the present invention to provide a new and improved shape recognition game which is of a durable and reliable construction.

An even further object of the present invention is to provide a new and improved shape recognition game which is susceptible of a low cost of manufacture with regard to both materials and labor, and which accordingly is then susceptible of low prices of sale to the consuming public, thereby making such shape recognition game economically available to the buying public.

Still yet another object of the present invention is to provide a new and improved shape recognition game which provides in the apparatuses and methods of the prior art some of the advantages thereof, while simultaneously overcoming some of the disadvantages normally associated therewith.

Still another object of the present invention is to provide a new and improved shape recognition game wherein the same provides pictorial clues to assist in players recognizing various objects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
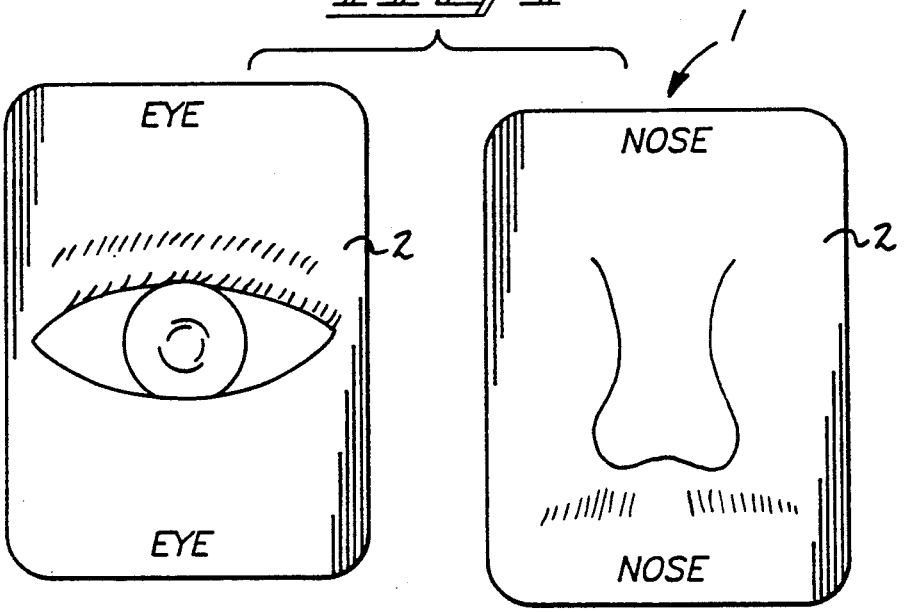
FIG. 1 ia a top orthographic view of a prior art card game utilizing pictorial representations.

With reference now to the drawings, and in particular to FIGS. 1 to 7 thereof, a new and improved shape recognition game embodying the principles and concepts of the present invention and generally designated by the reference numerals 11*a* through 43*a* will be described.

FIG. 1 illustrates a prior art shape association game 1, wherein cards 2 are provided with various human anatomical parts, in a manner as set forth in U.S. Pat. No. 4,315,628, to associate the pictorial represented part with an instruction to touch such part and effect physical exercise thereof.

Figure 2:
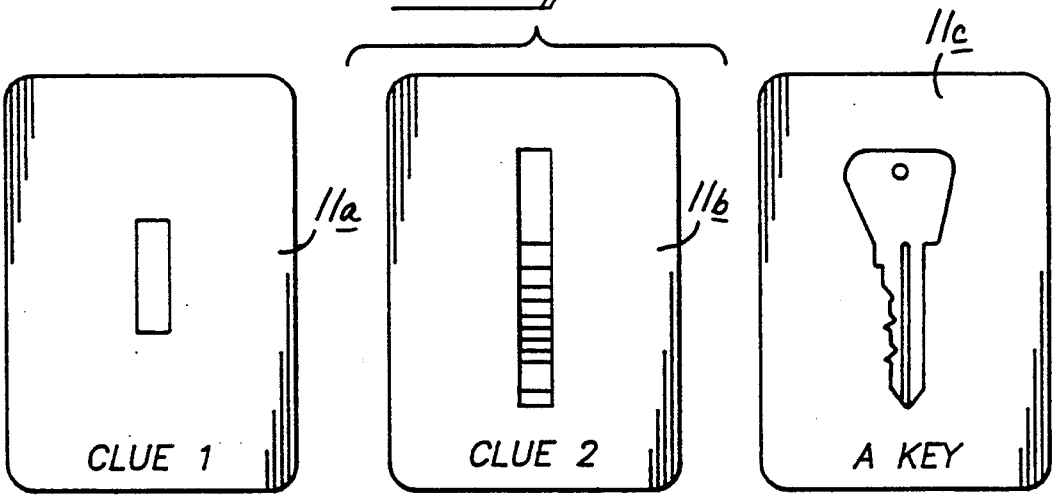
PRIOR ART FIG 2
FIG. 2 is a top orthographic view of a first series of clue cards utilized by the instant invention.
Figure 3:
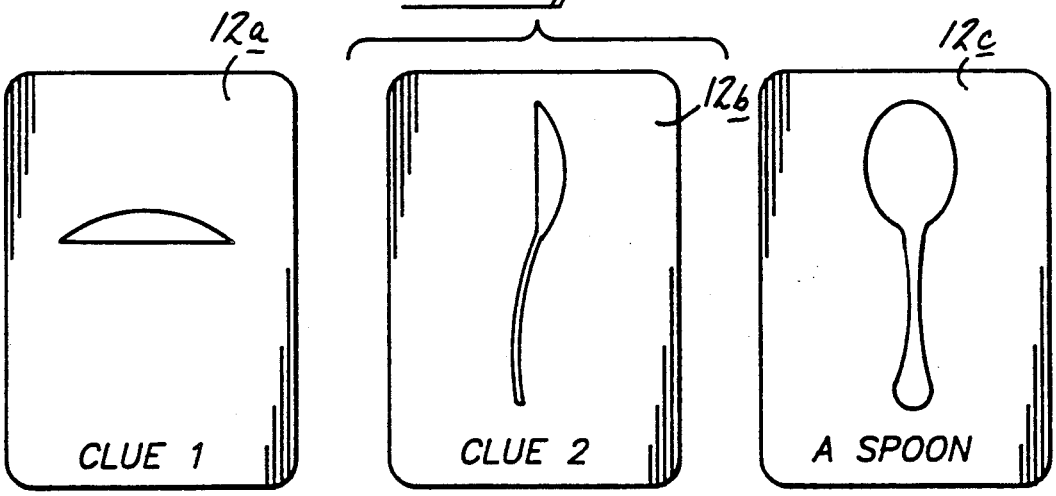
FIG. 3 is a top orthographic view of a further example of clue cards utilized by the instant invention.
Figure 4:
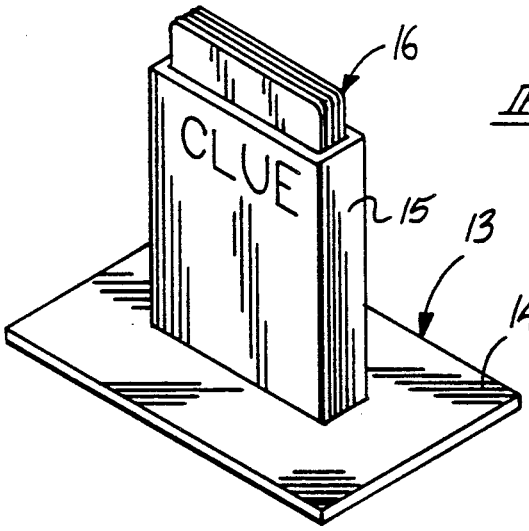
FIG. 4 is an isometric illustration of the clue card holder utilized by the instant invention.
Figure 5:
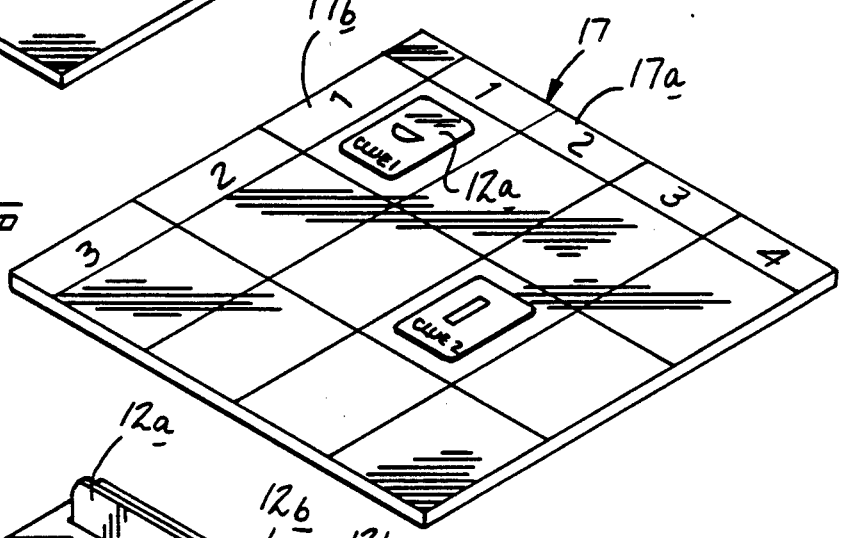
FIG. 5 is an isometric illustration of the positioning board utilized by the instant invention.
Figure 6:
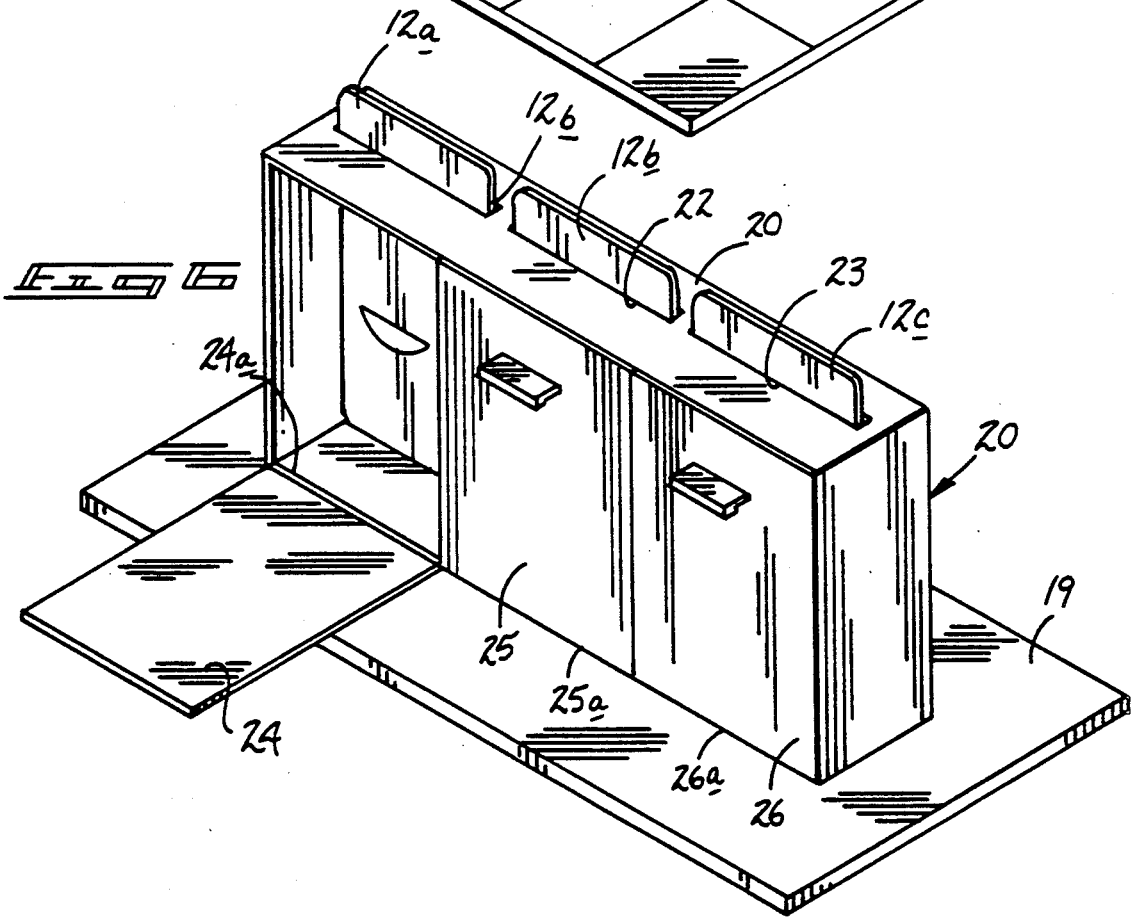
FIG. 6 is an isometric illustration of the viewing rack utilized by the instant invention.
Figure 7:
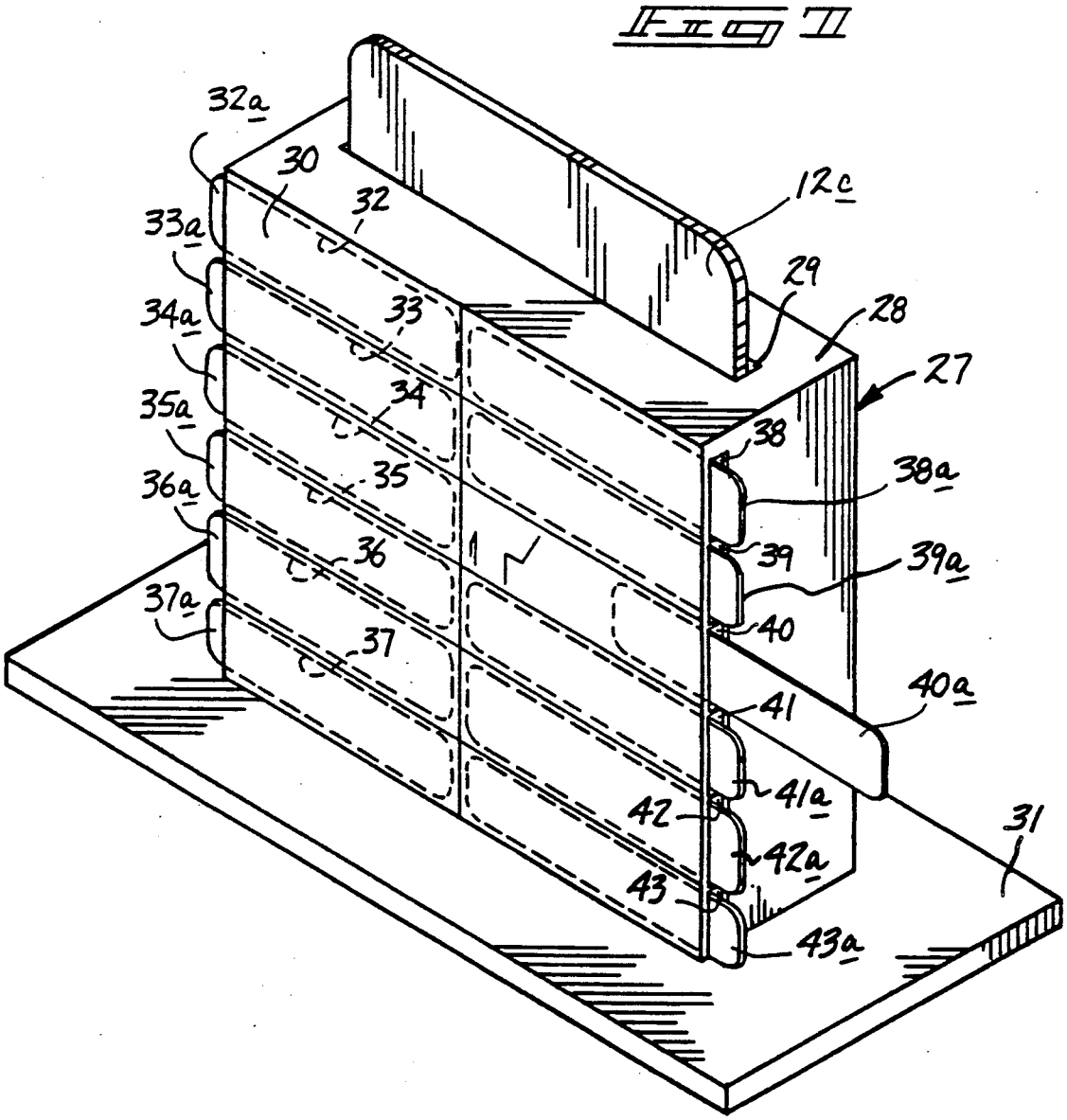
FIG. 7 is an isometric illustration of the alternative viewing container utilized by the instant invention.

More specifically, the shape recognition game of the instant invention essentially comprises a plural series of clue cards, as exemplified by FIGS. 2 and 3, each defined by a respective first, second, and third clue card. The first card member 11*a* defines a first clue card, the first card member second clue card 11*b*, and the first card member third clue card 11*c* define the first series of clue cards. By way of example, FIG. 3 illustrates a second card member first clue card 12*a*, a second card member second clue card 12*b*, and second card member third clue card 12*c*. The plural series of clue cards are secured within a card deck support 13 (see FIG. 4) that includes a support base 14 and a support container 15 orthogonally and medially mounted to an upper surface of the card deck support 13. As illustrated, each card of the deck of clue cards 16 is each defined by a predetermined card length, wherein support container 15 defines a receiver for the card deck 16, wherein the cavity is defined by a cavity height less than that of the clue cards to premit access to the clue cards during use. FIG. 5 illustrates the positioning board 17 utilized by the instant invention, wherein plural series of columns 17*a* and a plural series of rows 17*b* define respective positions, wherein the columns 17*a* define positions for each of the players, as typified by typically four players, wherein the rows 17*b* set forth as row 1, row 2, and row 3 respectively define a matrix of squares defined by the columns 17*a* and the row 17*b*. Positioning of an associated clue card in the now 1, as illustrated by clue card 12*a*, sets forth that the first guess by a player has not been successful, whereupon a second clue card is required by that player to effect a further guess as to the identity of the unknown object set forth by the clue cards 12*a*–12*c* of FIG. 3 for example. To this end, a viewing rack 18 is provided. A viewing rack base 19 medially and integrally mounts an elongate housing 20 thereon. The elongate housing includes a top wall, with a first, second, and third slot 21, 22, and 23 respectively directed through the top wall. The slots are aligned and equally spaced relative to one another, with each slot defining a respective compartment, wherein the first slot defines a first compartment thereunder, the second slot 22 defines a second compartment thereunder, and the third slot 23 defines a third compartment thereunder. A first door 24 overlies the first compartment, a second door 25 overlies the second compartment, and a third door 26 overlies the third compartment. Each door is hingedly mounted and defined by a respective first, second, and third door hinge 24*a*, 25*a*, and 26*a*. Each door thereby is manipulated by means of an associated door handle and directed downwardly to reveal the respective clue provided by each clue card positioned within each compartment. In play, recognition by use of the first clue card provides a first point total such as 25. Recognition by the second clue card provides a second point total 15, and recognition of the third clue provides a point total of 5. Alternatively, a player may in an effort to increase a point total awarded position the third clue card 12*c* for example within a respective alternative viewing container 27, as illustrated in FIG. 7. In this manner, the player may obtain a potential of 12 points rather than 5 points, dependent upon clues provided to that player by the alternative viewing container, as utilized in lieu of the third compartment. The alternative viewing container 27 includes an alternative viewing container top wall 28, including a top wall slot 29 directed therethrough to receive the third clue card, as exemplified by the third clue card 12*c*. The container 27 defines the container chamber therewithin that is defined by a chamber height less than the predetermined card height of the playing card 12*c*. The container 27 includes a transparent forward wall that includes a plurality of slots columns. The first slot column is defined by a first slot 32, a second slot 33, a third slot 34, a fourth slot 35, a fifth slot 36, and a sixth slot 37. Each of the slots are defined by a slot length and are arranged in a parallel relationship in the first slot column. The second slot column is defined by a respective seventh, eighth, ninth, tenth, eleventh, and twelfth slot 38, 39, 40, 41, 42, and 43. Slidably mounted within each slot is a respective opaque slider defined by opaque sliders 32*a*–43*a* positioned within each respective slot 32–43. In this manner, a player may select removal of an apaque slider from an associated slot to permit viewing access of the third clue card mounted within the chamber of the container 27. When the player effects discovery of the object provided by removal of a single opaque slider from a single slot, that player is awarded twelve points. Understandably, a point is removed for each opaque slider withdrawn from an associated slot until all twelve sliders are removed and all twelve points are forfeited by that player. Subsequent to play of the game, a player having accumulated the greatest point total is declared a winner. It should be further noted that the container 27 is provided prior to be mounted upon the container support base 31 to provide stability to the container in a manner similar to that as provided by the base of the viewing rack and the card deck support.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shape recognition game apparatus comprising, in combination, a plural series of clue cards defining a card deck, each series includes a plurality of clue cards defined by a first through penultimate clue card, and viewing means for selectively containing each series of clue cards to permit selective viewing of each clue card of the series of clue cards for effecting recognition of an object defined by each series of clue cards, and wherein the viewing means includes a viewing rack, the viewing rack includes an elongate housing, the longate housing defined by an elongate housing top wall, the top wall including a plurality of slots, the slots positioned in an aligned relationship through the elongate housing top wall and spaced apart an equal spacing, and each slot defining a compartment thereunder, with each compartment receiving a respective clue card of a respective series of clue cards, and wherein the elongate housing includes a plurality of doors, with a single door of said plurality of doors associated with each compartment, each single door including a hinge to pivotally mount each single door relative to each compartment to permit selective viewing access to each compartment and a respective clue card contained within each compartment, each single door positionable from a first position overlying each compartment to a second position exposing a respective clue card within each compartment.

2. A game as set forth in claim 1 wherein each single door is pivotally mounted to the housing, and each compartment is defined by a compartment length, and each clue card is defined by a clue card length, wherein the compartment length is less than the clue card length to permit manual grasping of a respective clue card positioned through a respective slot into a respective compartment.

3. A game as set forth in claim 2 wherein a penultimate number of compartments are provided within the elongate housing, with the penultimate of each series of clue cards positionable within the penultimate compartment, and an alternative viewing container provided to permit positioning of the penultimate clue card within the alternative viewing container in lieu of positioning the penultimate card within the penultimate compartment.

4. A game as set forth in claim 3 wherein the alternative viewing container includes an alternative viewing container top wall, and a transparent alternative viewing container forward wall, and the alternative viewing container includes an alternative viewing container slot directed through the top wall defining a container chamber within the alternative viewing container, wherein the container chamber is defined by a container chamber height less than the predetermined length of each clue card, and the forward wall including a plurality of columns of slots, including a first column and a second column, the first column including a first series of slot, wherein each slot of the first series of slot is arranged parallel relative to one another, and the second column of slots positioned adjacent the first column of slots includes a further plurality of slots, wherein each of the further plurality of slots are arranged parallel relative to one another, and an opaque slider selectively positionable within each slot to permit selective viewing access to a penultimate clue card contained within the container chamber.

* * * * *